US006752062B2

(12) United States Patent
Vais

(10) Patent No.: US 6,752,062 B2
(45) Date of Patent: Jun. 22, 2004

(54) MUZZLE BRAKE

(76) Inventor: George M. Vais, 182 S. Cole Rd., Boise, ID (US) 83709

( * ) Notice: Subject to any disclaimer, the term of this patent is extended or adjusted under 35 U.S.C. 154(b) by 0 days.

(21) Appl. No.: 10/004,999

(22) Filed: Dec. 7, 2001

(65) Prior Publication Data

US 2003/0106416 A1 Jun. 12, 2003

(51) Int. Cl.[7] ..... F41A 21/32
(52) U.S. Cl. ..... 89/14.3
(58) Field of Search ..... 89/14.3, 14.2, 89/14.4; D22/108

(56) References Cited

U.S. PATENT DOCUMENTS

| | | | | | |
|---|---|---|---|---|---|
| 1,427,802 | A | | 9/1922 | Goodwin | |
| 2,112,831 | A | | 4/1938 | Cutts, Jr. | 89/14 |
| 2,165,457 | A | * | 7/1939 | Cutts, Jr. | 89/14.3 |
| 2,322,370 | A | * | 6/1943 | Lance | 89/14.3 |
| 2,662,326 | A | | 12/1953 | Powell | 42/79 |
| 2,796,005 | A | * | 6/1957 | Shapel | 89/14.3 |
| 3,367,055 | A | | 2/1968 | Powell | 42/79 |
| 3,707,899 | A | | 1/1973 | Perrine | 89/14 C |
| D285,238 | S | * | 8/1986 | Cellini | 89/14.3 |
| D296,350 | S | * | 6/1988 | Cellini | 89/14.3 |
| 4,945,812 | A | * | 8/1990 | Mazzanti | 89/14.3 |
| 4,967,642 | A | * | 11/1990 | Mihaita | 89/126 |
| 5,119,716 | A | * | 6/1992 | Bartolles | 89/14.3 |
| 5,155,291 | A | * | 10/1992 | Dabrowski | 42/78 |
| 5,305,677 | A | * | 4/1994 | Kleinguenther et al. | 89/14.2 |
| 5,367,940 | A | | 11/1994 | Taylor | 89/14.3 |
| 5,476,028 | A | * | 12/1995 | Seberger | 89/14.3 |
| 5,509,345 | A | * | 4/1996 | Cyktich | 42/97 |
| 5,612,504 | A | | 3/1997 | Stitt et al. | 89/14.3 |
| 5,811,714 | A | * | 9/1998 | Hull et al. | 89/14.3 |
| 5,814,757 | A | * | 9/1998 | Buss | 89/14.3 |

FOREIGN PATENT DOCUMENTS

| | | | |
|---|---|---|---|
| DE | DT0214226 | * | 10/1909 |
| GB | 0292633 | * | 6/1928 |

* cited by examiner

*Primary Examiner*—Michael J. Carone
*Assistant Examiner*—Troy Chambers
(74) *Attorney, Agent, or Firm*—Derek H. Maughan; Frank J. Dykas; Robert L. Shaver

(57) ABSTRACT

A muzzle brake for dissipating a recoil force created by the discharge of a firearm having a muzzle, without a substantially increasing the noise heard by the shooter. The muzzle brake is a cylinder with at least one opening radially disposed from a central bore. These radial openings have a longitudinal dimension greater than a lateral dimension and help to dissipate force-causing gasses away from the muzzle end of a firearm with reduced reflection of gasses back towards the shooter. The decreased amount gas reflected back toward the shooter decreases the amount of noise the shooter hears.

7 Claims, 9 Drawing Sheets

MUZZLE BRAKE

BACKGROUND OF THE INVENTION

1. Field of the Invention

The present invention generally relates to a muzzle brake for firearms and more particularly to a muzzle brake for firearms that decreases the amount of noise perceived by the shooter.

2. Background Information

When a high-powered rifle is fired, the gas that ejects the projectile out of the end of the firearm accumulates behind the projectile and upon discharge from the firearm creates a recoil force back towards the shooter. This recoil force can be quite severe, especially in high-powered rifles, and results in pain, discomfort, and fatigue to the shooter. To reduce these side effects, "muzzle brakes" are used to lessen this recoil force back towards the shooter.

Most muzzle brakes comprise an attachment placed on the muzzle end of a firearm which reduces recoil by dissipating propellant gasses radially from the direction of the barrel of the firearm through a series of openings within the attachment. In deflecting the gas away from the end of the barrel, some of the gas impinges on the opening surfaces on the muzzle brake itself and is reflected back towards the shooter. This reflection directs more sound energy from the muzzle blast back toward the shooter. Thus, firearms equipped with conventional muzzle brakes often sound much louder to the shooter than the same firearm with no muzzle brake. Hence, one must choose either increased recoil force or increased noise in order to operate the firearm. What is needed is a muzzle brake that functions to reduce the recoil force felt by the shooter without a substantial increase in noise perceived by the shooter.

Accordingly, it is an object of the invention to reduce the recoil force felt upon discharge of a firearm in a manner that is significantly more quiet than existing muzzle brakes.

Additional objects, advantages, and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The present invention is a muzzle brake device for reducing recoil and limiting noise upon the discharge of a firearm having a muzzle. One embodiment of the present invention is made up of a cylinder having: a first end adapted for attachment to the muzzle of a firearm, an outer surface extending from the first end to a second end along a longitudinal axis, a central bore of a desired diameter extending through the cylinder along the longitudinal axis, a plurality of radial gas holes extending from the central bore to the outer surface and generally linearly disposed along the longitudinal axis within the outer surface, at least one channel within the outer surface that connects a first gas hole to a second gas hole longitudinally proximate to the first gas hole, and the second gas hole to a third gas hole longitudinally proximate to the second gas hole. This combination creates at least one opening extending radially from the central bore to the outer surface having a longitudinal dimension greater than a lateral dimension.

In use, when a projectile proceeds out through the invented muzzle brake the resulting gasses are dispersed radially, away from the direction of the barrel of the firearm. The openings formed by the combination of channels and gas holes facilitates the dispersion of these gasses away from the muzzle brake in such a manner whereby the reflection of gasses off the muzzle brake and back towards the shooter is reduced. This reduction in reflected gasses correlates with a significant decrease in noise perceived by the shooter when using this muzzle brake compared to other muzzle brakes.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
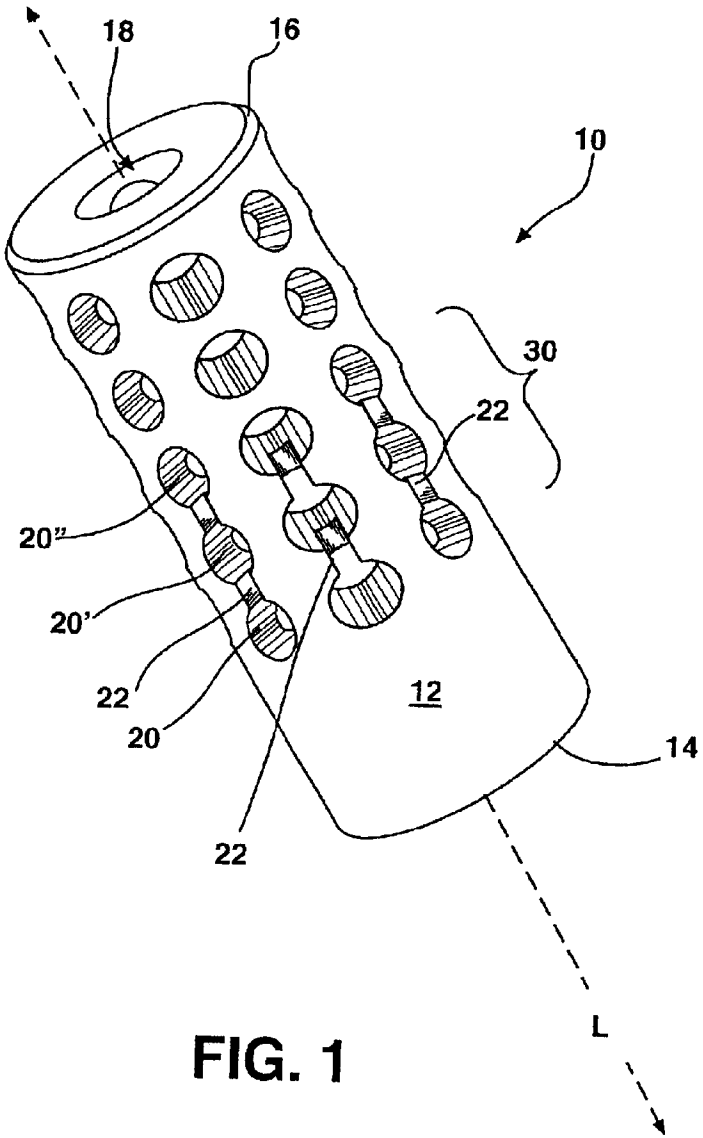
FIG. 1 is a perspective view of a first embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a muzzle brake for reducing recoil and noise occasioned by the discharge of a firearm. Referring initially to FIG. 1, a first embodiment of the present invention is shown. The invented muzzle brake 10 is made up of a body, preferably a cylinder although any shape may be used, having an outer surface 12 extending from a first end 14 configured for connection to the muzzle of a firearm (not shown) to a second end 16 along a longitudinal axis L. A central bore 18 of a desired diameter extends therethrough along the longitudinal axis L of the cylinder. A series of radial gas holes 20, 20', 20" extend from the first end 14 along the longitudinal axis L in a linear fashion towards the second end 16. Each radial gas hole 20,20', 20" extends from the central bore 18 to the outer surface 12.

In this embodiment, between the gas holes 20, 20', 20" closest to the first end 14 are a series of channels 22, within the outer surface 12. These channels 22 connect a first gas hole 20 to a second gas hole 20' generally linearly longitudinally disposed from the first gas hole 20 and a second gas hole 20' to a third gas hole 20" generally linearly longitudinally disposed to the second gas hole 20'. While the gas holes 20 extend from the outer surface 12 to the central bore 18, in this embodiment the channels 22 in the outer surface do not extend all the way to the central bore 18. The combination of the channels 22 and the gas holes 20, 20', 20" forms an opening 30 in the outer surface of the muzzle brake 12 having a volume greater than the volume of a single gas hole 20 alone.

While in this embodiment the body and the holes are shown to be cylindrical in shape, it is to be distinctly understood that any shape may be used for the body, holes, channels or opening as long as the longitudinal dimension of the opening is greater than the lateral dimension of that opening. The shape of the body shown is cylindrical to allow for ease in manufacturing and to conform with the customary use of cylindrical shaped muzzle brakes in the art. However, the shape of the body is not limited to a cylinder alone.

In use, when the firearm is discharged, the gasses propelling the projectile exit the muzzle brake 10 though the radial gas holes 20 and are dispersed away from the longitudinal axis of the muzzle brake. The openings 30 formed by the combination of the gas holes 20 and the channels 22 have a greater longitudinal dimension and a larger area than the single gas holes 20 located near the second end 16 of the muzzle brake 10. As a result, when the propellant gasses are dispersed, more of the gasses are dissipated through the longer opening 30 away from the direction of barrel of the firearm and less of the gasses are reflected back toward the shooter. The reduction in the reflection of gasses correlates to a reduction in noise perceived by the shooter upon discharge of the firearm.

Figure 2:
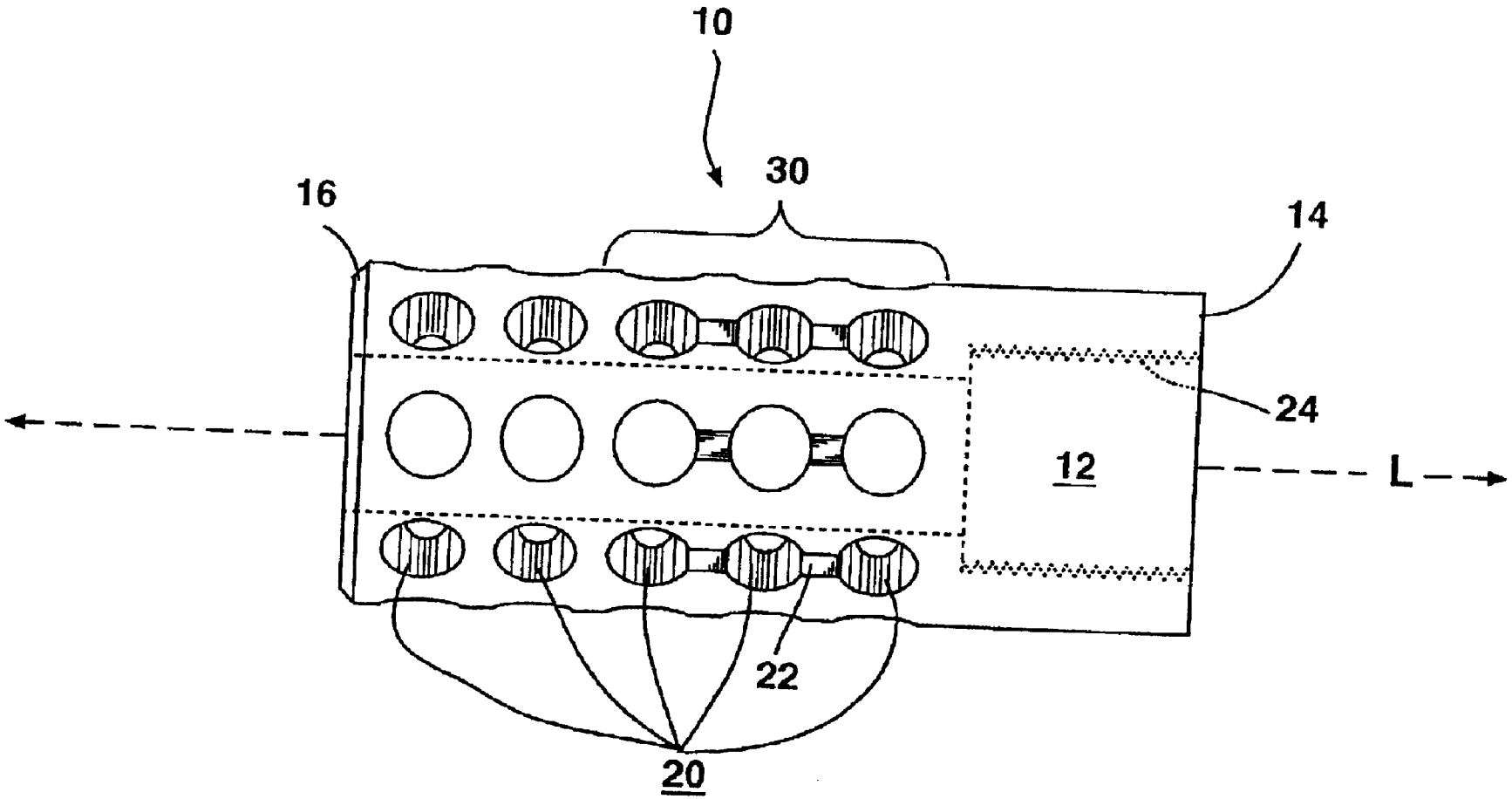
FIG. 2 is an elevational view of the embodiment shown in FIG. 1

FIG. 2 shows an elevational view of the embodiment shown in FIG. 1, further showing the position of a means for attaching 24 the muzzle brake 10 to a firearm. In this embodiment the means of attachment 24 is a threaded means, however such an attachment may also be accomplished by a coupling or any other means sufficient to adequately connect the muzzle brake to the muzzle end of a firearm including those typical in the prior art. It is to be understood that the gas holes on the surface of the cylinder 20 are disposed radially around the entire outer surface of the cylinder 12.

Figure 3:
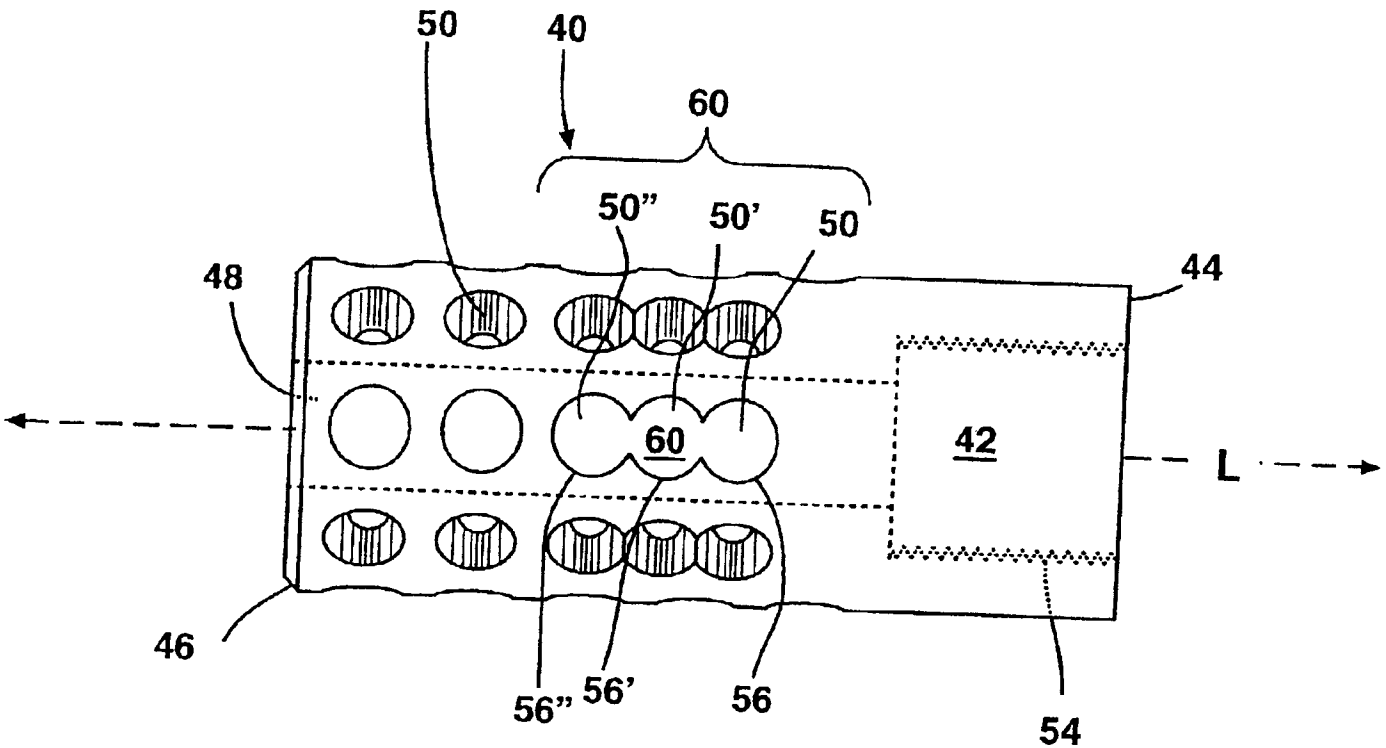
FIG. 3 is an elevational view of a second embodiment of the present invention.

FIG. 3 shows an elevational view of a second embodiment of the present invention. This second embodiment comprises a body 40 having an outer surface 42, a first end 44 extending to a second end 46 along a generally longitudinal axis L, and a central bore 48 passing therethrough along the generally longitudinal axis. The first end 44 of the body 40 contains a means for attaching 54 the muzzle brake to a firearm. The second end 46 of the body 40 is adapted to discharge a projectile though the central bore 48. The outer surface of the body 42 has a series of radial gas holes 50, 50', 50" linearly disposed along the generally longitudinal axis L. Each radial gas hole 50,50', 50" has a perimeter 56,56', 56" extending from the central bore 48 to the outer surface 42.

The radial gas holes 50, 50', 50" closest to the first end 44 are interconnected by drilling the radial gas holes 50,50', 50" so that the perimeter 56 of a first radial gas hole 50 overlaps the perimeter 56' of a second radial gas hole 50' lying generally linearly longitudinally proximate to the first radial gas hole 50, and that the perimeter 56' of the second radial gas hole 50 overlaps with the perimeter 56" of a third radial gas hole 50" longitudinally linearly proximate to the second radial gas hole 50'. This combination of a first radial gas hole 50, a second radial gas hole 50' and a third radial gas hole 50" all overlappingly interconnected at their respective perimeters creates an opening 60 having a greater longitudinal dimension and area than the opening of a single radial gas hole 50 alone. Hence, when a projectile is discharged through the central bore 48; the gasses accompanying the projectile are disbursed radially away from the central bore 48. The increased size of the openings 60 nearest to the first end 44 of the firearm facilitates the radial dispersion of propellant gasses whereby less of the gasses are reflected back toward the shooter. This results in decreased noise perceived by the shooter of the firearm upon discharge.

Figure 4:
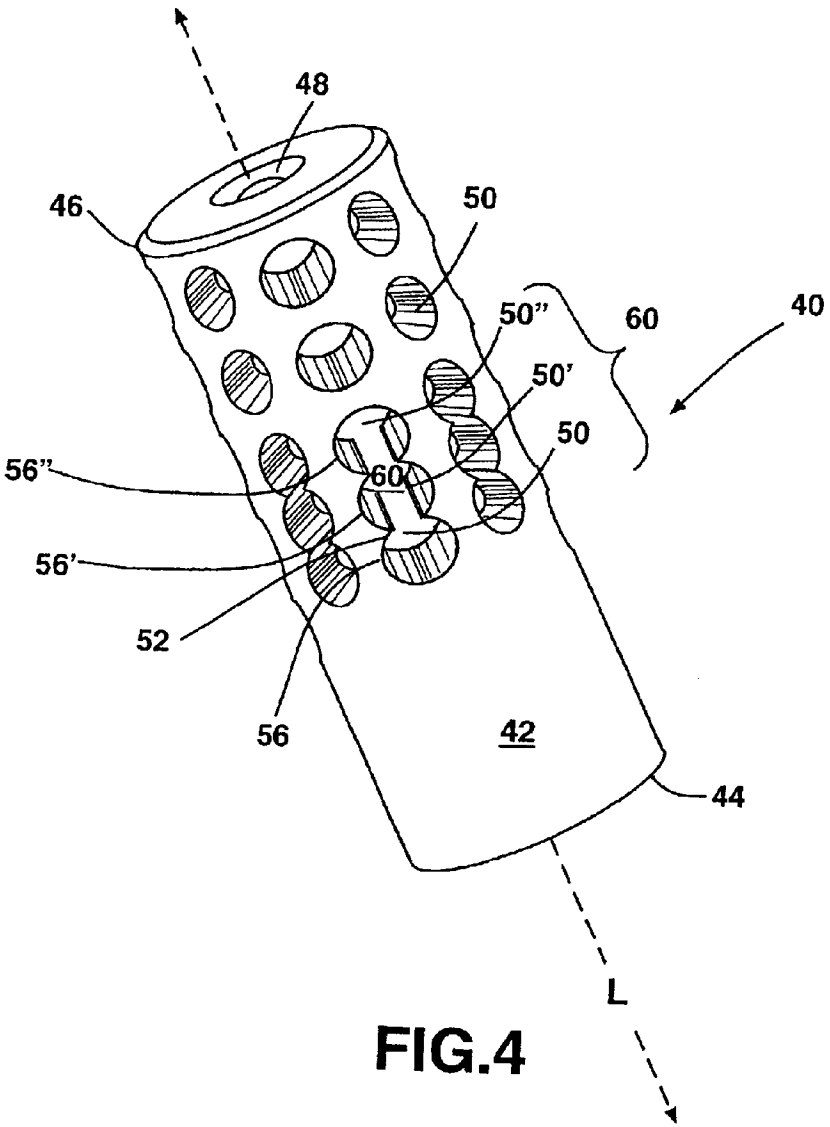
FIG. 4 is a perspective view of the embodiment shown in FIG. 3.

FIG. 4 is a perspective view of the embodiment shown in FIG. 3.

Figure 5:
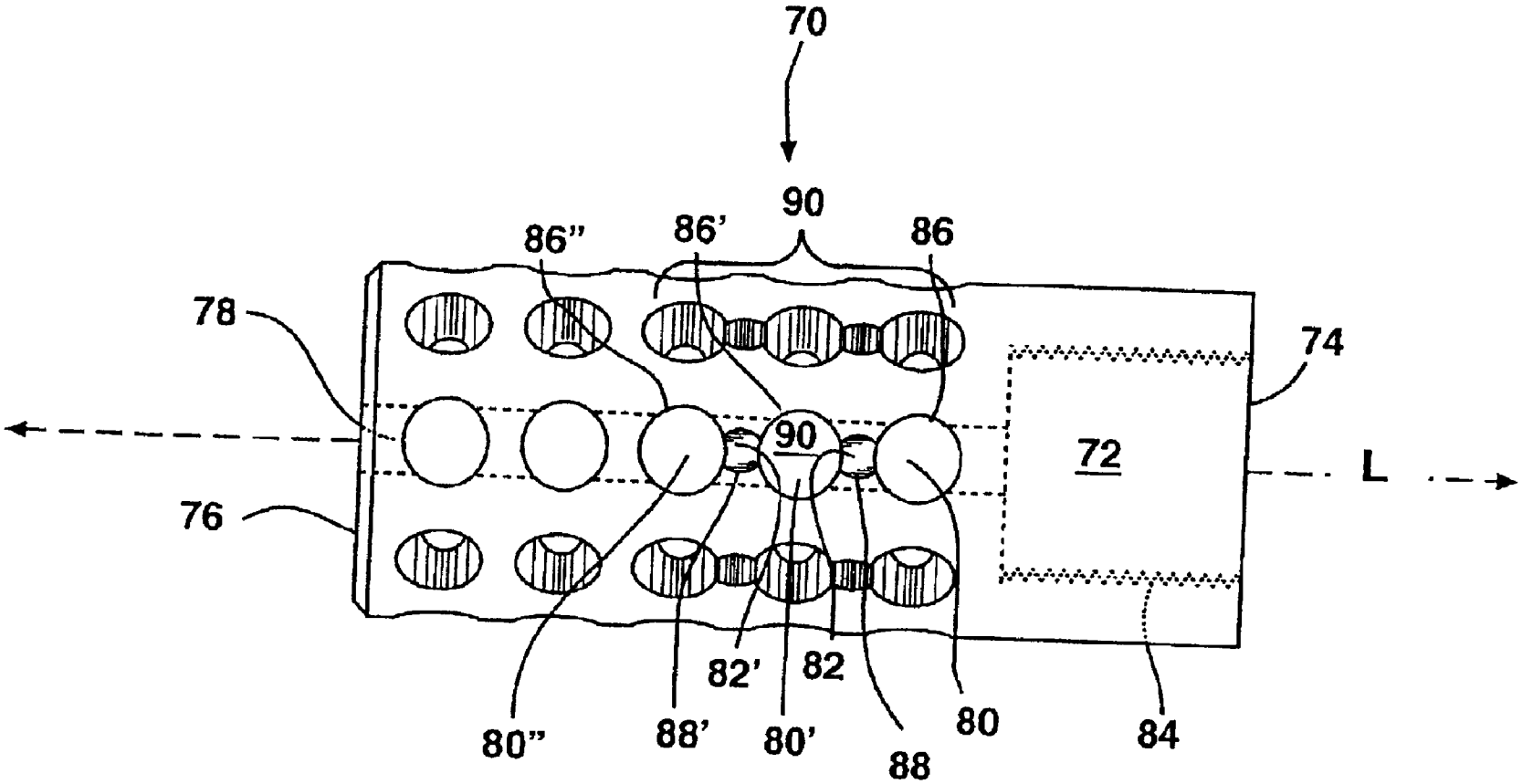
FIG. 5 is an elevational view of a third embodiment of the invention.

FIG. 5 is an elevational view of a third embodiment of the invention. This embodiment is made up of a cylinder 70 having an outer surface 72, a first end 74 extending to a second end 76 along a longitudinal axis, and a central bore 78 passing therethrough along a longitudinal axis. The first end 74 of the cylinder contains a means for attaching 84 the muzzle brake to a firearm. The second end 76 of the cylinder is adapted to discharge a projectile though the central bore 78. The outer surface 72 of the cylinder has a series of linearly disposed radial gas holes 80, 80', 80" that extend from the first end 74 of the muzzle brake to the second end 76 of the muzzle brake along a longitudinal axis L. Each radial gas hole 80,80', 80" has a perimeter 86, 86', 86" and a passage that extends from the central bore 78 to the outer surface 72 of the cylinder.

In this embodiment, the radial gas holes 80, 80', 80" closest to the first end 74 of the firearm are connected to form an opening 90 by drilling at least one channel pore 82 in the outer surface 72 of the cylinder. Each channel pore 82 extends from the outer surface 72 inward toward the central bore 78 but does not connect with the central bore 78. Additionally, each channel pore has a perimeter 88. A first channel pore 82 is positioned so that the first channel pore perimeter 88 circumferentially overlaps both the perimeter of a first radial gas hole 86 and the perimeter 86' of a second radial gas hole 80' linearly disposed along the longitudinal axis from the first radial gas hole 80.

Preferably, second channel pore 82' is similarly formed between the second radial gas hole 80' and a third radial gas hole 80" by drilling a second channel pore 82' so that the perimeter 88' of a second channel gas hole 82' overlaps the perimeter 86' of the second radial gas hole 80' and the perimeter 86" of a third radial gas hole 80" linearly disposed along the longitudinal axis from the second radial gas hole. This combination creates an opening 90 having a greater longitudinal dimension and area than the opening of a single radial gas hole 80 alone. Hence, when a projectile is discharged through the central bore 78 of the cylinder; the gasses accompanying the projectile are disbursed radially away from the central bore 78 outward. The increased size of the openings 90 nearest to the muzzle end of the firearm facilitate the dispersing of propellant gasses in such a manner whereby more of the gas is dissipated and less of the gas is reflected off the muzzle brake back towards the shooter. This results in decreased noise perceived by the shooter of the firearm upon discharge.

Figure 6:
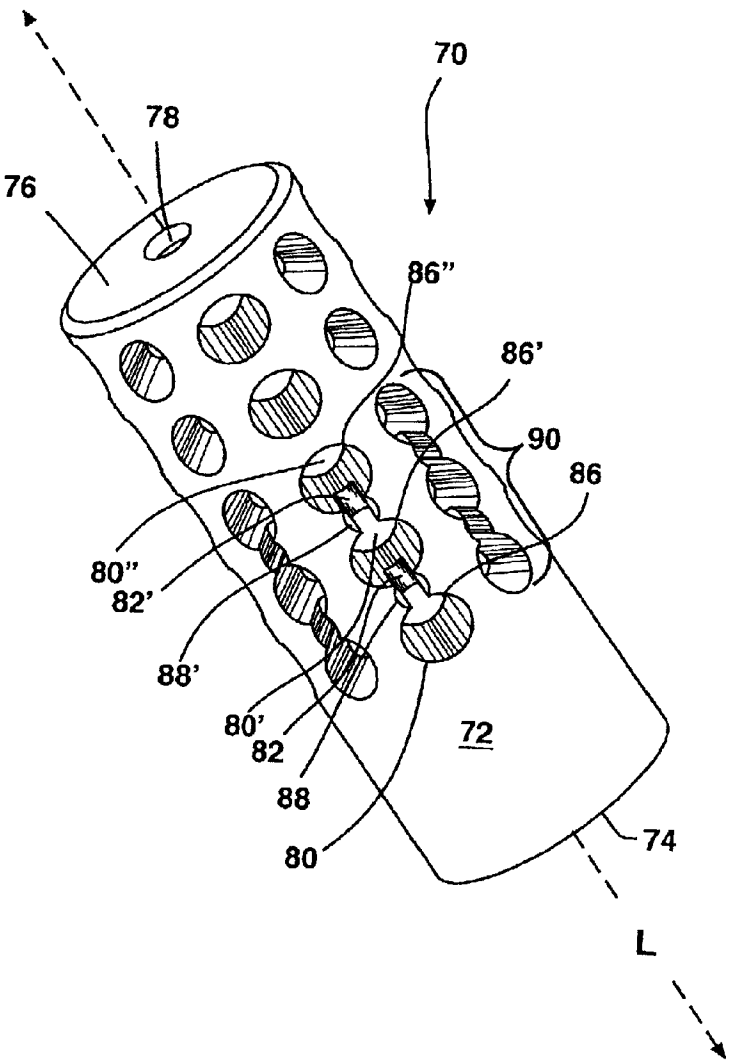
FIG. 6 is a perspective view of the embodiment of the invention shown in FIG. 5.

FIG. 6 shows a perspective view of the third embodiment shown in FIG. 5.

Figure 7:
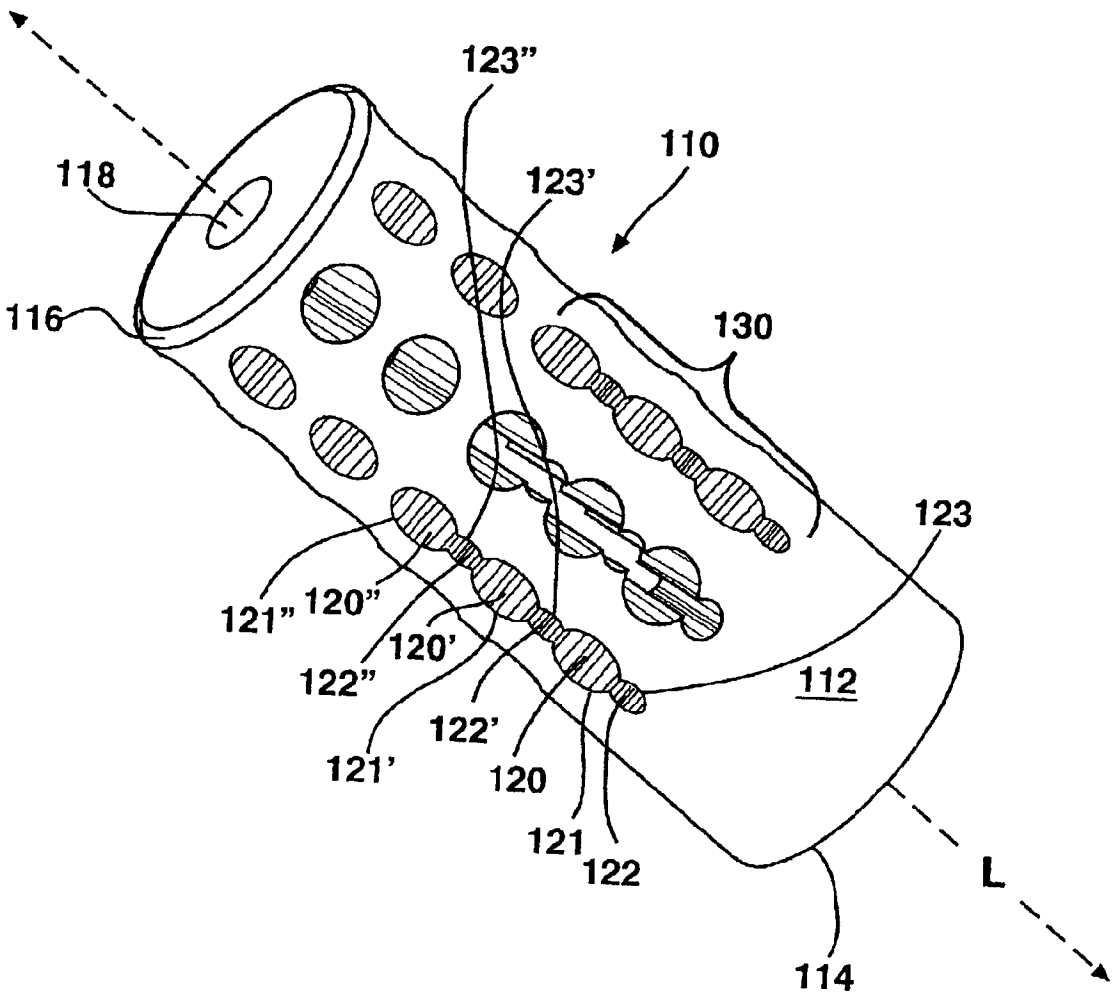
FIG. 7 is a perspective view of a fourth embodiment of the invention

FIG. 7 shows the preferred, fourth embodiment of the invention. The invented muzzle brake is made up of a cylinder 110 having a circumvolving outer surface 112 extending from a first end 114 configured for connection to the muzzle end of a firearm (not shown) to a second end 116 along a longitudinal axis L. A central bore 118 of a desired diameter extends therethrough along the longitudinal axis L. A series of radial gas holes 120,120', 120" extend from the first or muzzle end of the firearm along the longitudinal axis in a linear fashion towards the second end 116. Each radial gas hole has a periphery 121 and extends from the central bore 118 outward to the outer surface 112.

Between the radial gas holes 120 closest to the first end 114 are a series of connecting pores 122 within the outer surface 112. Each connecting pore 122 has a periphery 123 and extends from the central bore 118 to the outer surface 112. A first connecting pore 122 is disposed near the first end 114 of the muzzle brake. The periphery 123 of the first connecting pore 122 overlaps the periphery of a first gas hole 120. A second connecting pore 122' having a periphery 123' is disposed between the first gas hole 120 and a second gas hole 120'. The second gas hole 120' also has a periphery 121' and is linearly longitudinally disposed proximate to the first gas hole 120. Whereby, the periphery of said second connecting pore 123' overlaps the periphery 121 of the first gas hole 120 and the periphery 121' of the second gas hole 120'. A third connecting pore 122" having a periphery 123" is disposed between the second gas hole 120' and a third gas hole 120" having a periphery 121" and is linearly longitudinally disposed from said second gas hole 120'. Whereby the periphery of the third connecting pore 123" overlaps the peripheries of both the second gas hole 121' and the periphery third gas hole 121". The combination of the first connecting pore 122, first gas hole 120, second connecting pore 122', second gas hole 120', third connecting pore 122" and third gas hole 120" creates an opening 130 having a longitudinal dimension greater than the longitudinal dimension of a single gas hole 120 alone.

While in this embodiment the holes and pores are shown to be cylindrical in shape, it is to be distinctly understood that any shape may be used for the holes, channels, pores or openings as long as the longitudinal dimension of the resulting opening is greater than the lateral dimension of the same opening. Furthermore the size of the openings must be greater near the first end 114 of the muzzle brake and smaller near the second or discharge end 116.

Figure 8:
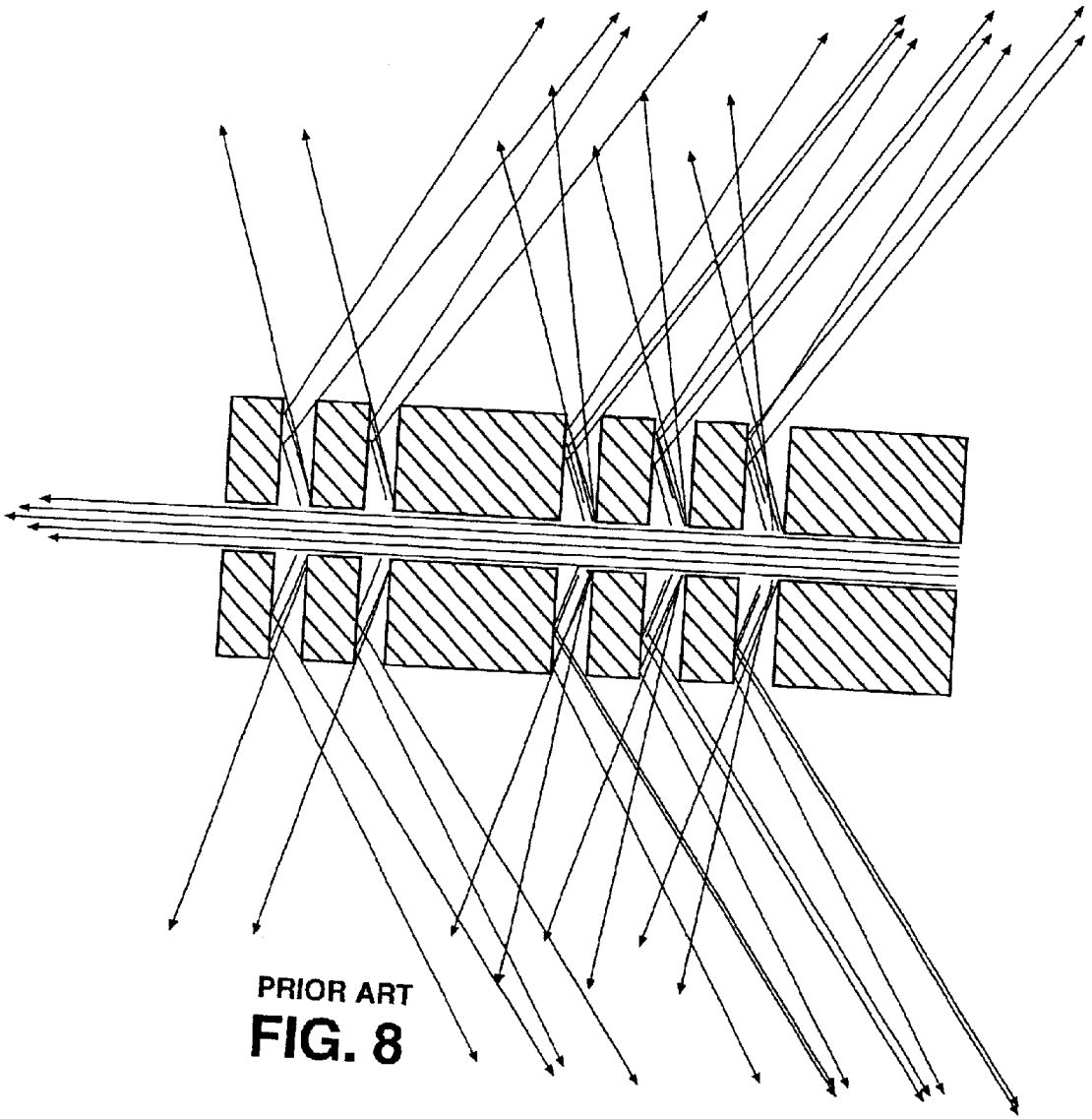
PRIOR ART FIG. 8
FIG. 8 is an elevational cross-sectional view of a typical prior art muzzle brake showing the reflection of gasses back towards the shooter

FIG. 8 shows a cross-section of a prior art embodiment showing the impact and reflection of gasses off of the surface of the muzzle brake device and back towards the shooter.

Figure 9:
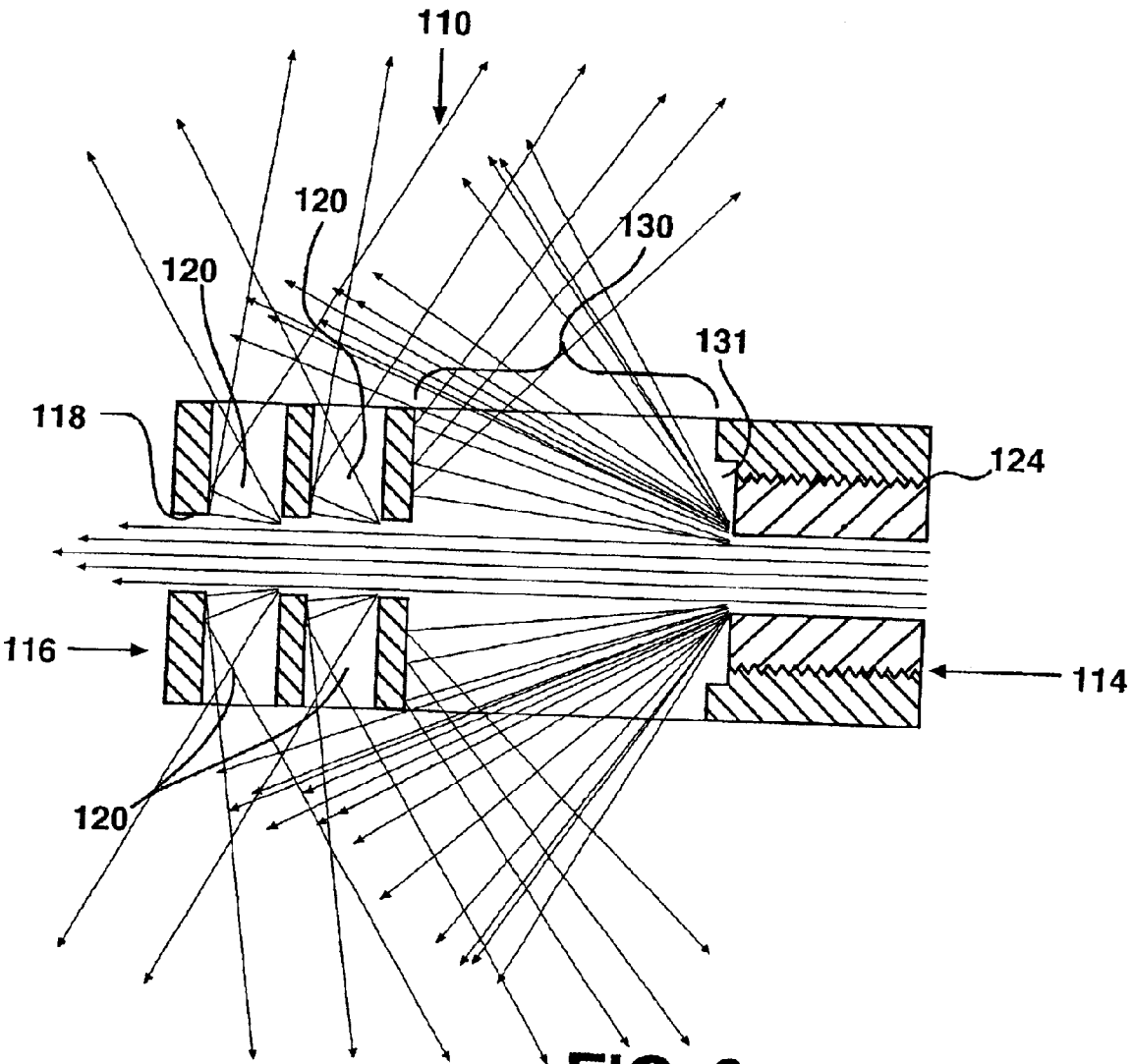
FIG. 9 is an elevational cross-sectional view of the present invention showing a decrease in the reflection of gasses back towards the shooter.

FIG. 9 shows a cross-section of the preferred fourth embodiment of the present invention showing the impact and reflection of gasses off of the muzzle brake. This figure also shows a means for attachment to a firearm 124, and a circumvolving cut groove 131 extending from the means of attachment portion 124 to the opening 130. This cut out groove or chamber 131 aids in the dispersion of gasses and reduces the amount of noise perceived by the shooter. When the firearm is discharged the gasses propelling the projectile exit the muzzle brake 110 though the openings 130 and are dispersed radially away from the longitudinal axis of the muzzle brake of the firearm. These openings 130 near the first end 114, have a greater longitudinal dimension than those gas holes 120 located near the second end of the muzzle brake 116, and facilitate the passage of gasses away from the muzzle brake in such a manner whereby reflection of gasses back toward the shooter is diminished. The reduction in the reflection of gasses correlates to a reduction in noise perceived by the shooter upon discharge of the firearm.

The gas dispersing capability and hence the reduction in noise by this muzzle brake is further enhanced by undercutting the inner surface of the central bore 118 to create a circumvolving cut out groove or chamber 131 which facilitates the radial dispersion of gasses away from the end of the gun, as shown in FIG. 9. The inclusion of this cut out groove results in a one-half decibel decrease in noise perceived by the shooter.

Comparing FIG. 8 to FIG. 9 we see that the amount of gas reflected back toward the shooter is substantially less in FIG. 9 than in FIG. 8. This reduction in reflected gasses correlates to a reduction in noise perceived by the shooter.

While several embodiments have been shown it is to be distinctly understood that combinations of the various features of the several embodiments may be combined to achieve the same desired result. Furthermore, while the shape of the muzzle brake is generally cylindrical it is to be distinctly understood that any shape or configuration may be used for the muzzle brake, the openings, gas holes, or central bore.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A muzzle brake configured for attachment to a firearm muzzle, said muzzle brake configured to dissipate recoil force producing gasses away from the location of a shooter, said muzzle brake comprising:

a body having a first end adapted for attachment to a muzzle, an outer surface extending from said first end to a second end along a generally longitudinal axis, a central bore configured to allow passage of a projectile from said first end to said second end along said generally longitudinal axis, said body defining at least three elongated openings and a plurality of secondary radial gas holes, said secondary radial gas holes located within said body distal from said first end, each of said radial gas holes having a perimeter and extending radially from said central bore to said outer surface said elongated openings positioned nearest to said first end as compared to any other aperture defined within said outer surface of said muzzle brake, each of said elongated openings having a longitudinal dimension and a lateral dimension, said longitudinal dimension being greater than said lateral dimension, said elongated openings having a greater longitudinal dimension than any other aperture defined within said muzzle brake, said elongated openings configured to connect said central bore to said outer surface and to facilitate the passage of gasses propelling a projectile away from said first end of said muzzle brake.

2. The muzzle brake of claim 1 wherein said radial gas holes are generally linearly disposed along said longitudinal axis of said body.

3. The muzzle brake of claim 2 wherein said elongated openings are comprised of a first radial gas hole defined within said body, said first radial gas hole having a first radial gas hole perimeter, and extending from said central bore to said outer surface, said first radial gas hole connected to a second radial gas hole defined within said body, said second radial gas hole having a second radial gas hole perimeter, and extending radially from said central bore to said outer surface, said first radial gas hole perimeter configured to overlap said second gas hole perimeter.

4. The muzzle brake of claim 2 wherein said elongated openings are comprised of a first radial gas hole defined within said body, said first radial gas hole having a first radial gas hole perimeter, and extending from said central bore to said outer surface, said first radial gas hole positioned proximate to a second radial gas hole defined within said body, said second radial gas hole having a second radial gas hole perimeter, and extending from said central bore to said outer surface, said second radial gas hole positioned proximate to a third gas hole defined within said body, said third gas hole having a third gas hole perimeter and extending from said central bore to said outer surface, said first radial gas hole perimeter configured to overlap said second gas hole perimeter, and said second gas hole perimeter configured to overlap said first gas hole perimeter and said third gas hole perimeter.

5. A muzzle brake configured for use with a firearm having a muzzle, said muzzle brake configured for reducing recoil while discharging said firearm, said muzzle brake comprising:

a cylinder having a first end adapted for attachment to a firearm, an outer surface extending from said first end to a second end along a longitudinal axis, a central bore configured to allow passage of a projectile through said cylinder, said outer surface defining at least three elongated first openings, and a plurality of secondary radial gas holes said elongated first openings positioned nearest to said first end as compared to any other aperture defined within said outer surface of said muzzle brake, said elongated first openings positioned circumvolving around said outer surface near said first end, said first openings configured to have a longitudinal dimension and a lateral dimension, said longitudinal dimension being greater than said lateral dimension, said first openings having a greater longitudinal dimension than the longitudinal dimension of any other opening defined within said cylinder, said first openings further configured to extend from said central bore to said outer surface, said first elongated openings configured to direct discharge of propellant gasses away from said first end of said muzzle brake;

and a plurality of radial gas holes, said radial gas holes located proximate to said first openings and distal from said first end, said first end configured for attachment to the muzzle of a firearm; said central bore having a desired diameter and extending through the cylinder along said longitudinal axis; said radial gas holes linearly disposed along the longitudinal axis of the cylinder, each gas hole having a perimeter and a diameter smaller than said central bore, and extending radially from said central bore to said outer surface.

6. The muzzle brake of claim 5 wherein said opening is a first radial gas hole defined within said cylinder having a first radial gas hole perimeter, and extending from said central bore to said outer surface connected to a first channel defined within said outer surface, said first channel also connected to a second radial gas hole defined within said cylinder having a second radial gas hole perimeter, and extending radially from said central bore to said outer surface; said second radial gas hole being connected to a second channel, defined within said outer surface, said second channel also connected to a third gas hole defined within said cylinder having a third gas hole perimeter and extending from said central bore to said outer surface.

7. The muzzle brake of claim 5 wherein each of said first openings are formed by a first radial gas hole defined within said cylinder, said first radial gas hole having a first radial gas hole perimeter, and extending from said central bore to said outer surface, said first radial gas hole connected to a second radial gas hole defined within said cylinder said second radial gas hole having a second radial gas hole perimeter, and extending radially from said central bore to said outer surface cylinder, said first radial gas hole perimeter configured to overlap said second gas hole perimeter.

* * * * *